US005821495A

United States Patent [19]

Maki

[11] Patent Number: 5,821,495

[45] Date of Patent: Oct. 13, 1998

[54] GAS CIRCUIT BREAKER

[75] Inventor: Kazuyoshi Maki, Saga-Ken, Japan

[73] Assignee: Togami Electric Mfg. Co., Ltd., Japan

[21] Appl. No.: 633,210

[22] Filed: Apr. 16, 1996

[30] Foreign Application Priority Data

Apr. 28, 1995 [JP] Japan ..... 7-129293

[51] Int. Cl.[6] ..... H01H 33/70; H01H 33/42; H01H 31/28

[52] U.S. Cl. ..... 218/68; 218/74; 218/78; 218/146

[58] Field of Search ..... 200/249–251, 200/259–261; 218/22–88, 146

[56] References Cited

U.S. PATENT DOCUMENTS

| | | | |
|---|---|---|---|
| 2,979,590 | 4/1961 | Sandin | 218/58 |
| 3,259,724 | 7/1966 | Aspey et al. | 218/84 |
| 3,371,176 | 2/1968 | Leeds | 218/74 |
| 3,590,190 | 6/1971 | Colclaser, Jr. et al. | 218/43 |
| 3,876,846 | 4/1975 | Graybill | 218/68 |
| 4,095,069 | 6/1978 | Yeckley et al. | 218/68 |
| 4,184,191 | 1/1980 | Jinnai | 361/606 |
| 4,701,583 | 10/1987 | Mitsukuchi et al. | 218/71 |
| 5,483,031 | 1/1996 | Matsuda | 218/48 |

*Primary Examiner*—J. R. Scott
*Attorney, Agent, or Firm*—Rader, Fishman & Grauer

[57] ABSTRACT

A gas circuit breaker includes a case body in which an insulating gas is enclosed, a stationary contact part accommodated in the case body and equipped with tulip type stationary contact members, and a movable contact part having a movable contact member. The movable contact member is rotated about a main shaft serving as a fulcrum and makes and breaks a contact with the stationary contacts member, so that a large capacity electrical line can be closed and opened at a high speed.

7 Claims, 8 Drawing Sheets

GAS CIRCUIT BREAKER

BACKGROUND OF THE INVENTION

1. Field of the Invention

The present invention relates to a gas circuit breaker in which closing and opening of a movable contact member to a stationary contact member is carried out in an insulating gas, and more particularly to a gas circuit breaker having an improvement in a driving structure of a movable contact part.

2. Description of the Prior Art

There is a conventional gas circuit breaker of the above type shown in FIG. 1. FIG. 1 is a schematic cross-sectional view which explains an operation of a movable contact part of a conventional gas circuit breaker.

Referring to this figure, the conventional gas circuit breaker has the following structure. A sulfur hexafluoride gas (hereinafter, referred to as $SF_6$ gas) is enclosed in a case body 3 of a hermetically sealed chamber. A power supply side bushing 4 and a load side bushing 5 are disposed so that these bushings penetrate through two opposite walls of the case body 3. A stationary contact part 1 is attached to an inner end portion of the power supply side bushing 4. A movable contact part 2 is attached to an inner end portion of the load side bushing 5 through a guide rod 200. The stationary contact part 1 has a tulip (or plug) contact structure in which a plurality of stationary contact members 11 are arranged in a circular ring formation and are urged by a garter spring 12 so that each of the stationary contact members 11 exerts an inward elastic force.

The above movable contact part 2 has d hollow cylindrical body 210, into which the guide rod 200 is fitted. A movable contact member 21 is arranged at one end of the hollow cylindrical body 210. A current collecting contact member 201 is arranged at the other end of the hollow cylindrical body 210. The movable contact member 21 can linearly move so that the hollow cylindrical body 210 moves along the guide rod 200 in such a state in which the current collecting contact member 201 is slidably in contact with the outer surface of the guide rod 200. In the above linear movement of the movable contact member 21, the hollow cylindrical body 210, which engages an end of an insulating arm 23 rotatable by a rotation of a main shaft 6, linearly moves along the guide rod 200.

FIG. 2 shows a schematic cross-sectional view which explains the operation of a movable contact member of another conventional gas circuit breaker. Another conventional gas circuit breaker shown in FIG. 2 has a structural portion which is the same as used in the gas circuit breaker shown in FIG. 1. More particularly, the power supply side bushing 4 and the load side bushing 5 are arranged so as to respectively penetrate through the opposite walls of the case body 3 in which the gas $SF_6$ is enclosed. The stationary contact part 1 is attached to the power supply side bushing 4, and the movable contact part 2 is attached to the load side bushing 5. However, the conventional gas circuit breaker shown in FIG. 2 differs from that shown in FIG. 1 in that the closing and opening operations of the movable contact part 2 shown in FIG. 2 are based on a butt contact system. The movable contact part 2 has a structure such that a driving arm 230 rotates about the main shaft 6 so that the movable contact member 21 is rotated and makes and breaks a contact with the stationary contact members 11 in the vertical direction. The movable arm 230 is made of an electrically conductive substance and has a structure in which the movable contact member 21 is provided on a side surface of one end of the movable arm 230, and a flexible conductor 25 fastened to a conductor of the load side bushing 5 is connected to the other end thereof.

There is yet another conventional gas circuit breaker shown in FIG. 3, which is similar to the gas circuit breaker shown in FIG. 1 mentioned before. FIG. 3 is a schematic cross-sectional view which explains the operation of a movable contact member of such a conventional gas circuit breaker. As in the case of the gas circuit breaker shown in FIG. 1, the power supply side bushing 4 and the load side bushing 5 are arranged so as to respectively penetrate through the opposite walls of the case body 3 in which the gas $SF_6$ is enclosed. The stationary contact part 1 is attached to the power supply side bushing 4, and the movable contact part 2 is attached to the load side bushing 5. However, the conventional gas circuit breaker shown in FIG. 3 has a different structure for supporting the movable contact part 2 from that of the gas circuit breaker shown in FIG. 1. More particularly, the movable contact part 2 shown in FIG. 3 has a structure in which the outer circumference of the movable contact member 21 is supported by a through hole 202*a* of a guide frame 202 fastened to an inner wall of the base body 3 and is slidable in the through hole 202*a*.

The conventional gas circuit breakers structured as described above have the following problems. The gas circuit breaker shown in FIG. 1 has a problem in which the operation speed thereof is slow and has a long closing time and a long opening time due to a contact resistance generated by the linear movement of the current collecting contact member 201 of the movable contact part 2 along the guide rod 200. The gas circuit breaker shown in FIG. 3 has a problem in which the operation speed thereof is slow as in the case of the above gas circuit breaker because the outer circumference of the movable contact member 21 is supported by the through hole 202*a* of the guide frame 202. If the magnetmotive force of the a driving magnet is increased in order to eliminate the above problems, a large repulsive force will occur when the movable contact member 21 collides with the stationary contact members 11 in the closing operation and thus a recoil phenomenon will take place. Further, the current collecting contact member 201 will be welded and adhere to the guide rod 200. In the opening operation, the driving arm 230 is rotated by a great movement moment due to a large magnetmotive force, and it is thus necessary for the driving arm 230 to have a sufficient mechanical strength. This leads to an increase in the size and weight of the breaker device.

Furthermore, there are two contact parts, namely, the leading part of the movable contact member and the current collecting part. Hence, the reliability of the breaker obtained when conducting is low.

The gas circuit breaker of the butt contact type as shown in FIG. 2 does not have a serious problem when it is used as a small capacity circuit breaker. However, if the butt contact type circuit breaker is used as a middle capacity or large capacity circuit breaker, the circuit breaker will have a problem in which only a small number of contacts is available and use of an increased number of contacts enlarges the device size. Hence, under present conditions, the tulip contact structure having a small size and a large current capacity is employed in many cases.

SUMMARY OF THE INVENTION

It is a general object of the present invention to provide a gas circuit breaker in which the above problems are eliminated.

A more specific object of the present invention to provide a gas circuit breaker in which the closing and opening operations can be smoothly carried out at a higher speed and the device size can be reduced.

The above objects of the present invention are achieved by a gas circuit breaker comprising: a case body in which an insulating gas is enclosed; a stationary contact part accommodated in the case body and fixed to an inner wall of the case body, the stationary contact part of a tulip type in which a plurality of stationary contact members provided in an end thereof are inwardly urged and arranged in a circular ring formation; and a movable contact part accommodated in the case body and equipped with a movable contact member provided in an end of an insulating arm rotatably supported about a main shaft serving as a fulcrum, the insulating arm being rotated in response to a rotation of the main shaft so that the movable contact member makes and breaks a contact with the stationary contact members arranged in the circularly ring formation. The tulip type stationary contact part having stationary contact members arranged in the tulip formation and the movable contact part having the movable contact member are accommodated in the base body in which the insulating gas is enclosed, and the movable contact part is rotatable about the shaft with respect to the stationary contact part, whereby a large-capacity electric line can be closed and opened at a high speed.

The movable contact part may support the insulating arm through an elastic member which expands and contracts in almost the same direction as a rotation of the movable contact part. Hence,it is possible to relax shock occurring when the movable contact member makes a contact with the stationary contact members, so that the recoil phenomenon occurring at the time of closing and opening can be eliminated and welding of the contact members can be prevented. This contributes to smoother closing and opening operations.

The elastic member of the movable contact part may have an elastic force approximately equal to or slightly greater than a load generated when the movable contact member is engaged with and inserted into the stationary contact members. Hence, it is possible to suitably relax shock at the time of closing so that the closing and opening operation can be smoothed.

The elastic member of the movable contact part may have an elastic force approximately equal to or slightly greater than a load generated when the movable contact member is engaged with and inserted into the stationary contact members, the elastic force being greater than an inward elastic force of the stationary contact members arranged in the circular ring formation. Hence, the closing load can be sufficiently absorbed because the elastic member is contacted due to the function of the elastic force (equal or less than the closing load) thereof. Then, the movable contact member can be smoothly inserted into the circular ring of the stationary contact members due to the inward elastic force less than the repulsive force (that is, elastic force) of the elastic member in the contracted state. As a result, it is possible to much more certainly perform the closing and opening operations and prevent the recoil phenomenon.

There may be provided a closing stopper stopping, in a predetermined position, a rotation of the movable contact member in a closing direction after the movable contact member moves to make a connection with the stationary contact members; and an opening stopper stopping, in another predetermined position, a rotation of the movable contact member in an opening direction after the movable contact member is released from the stationary contact members. Hence, at the time of closing, it is possible to prevent the movable contact member from excessively hitting the stationary contact members to hence prevent the parts from being damaged. At the time of opening, it is possible to prevent the movable contact members and the other parts from being damaged due to inertia force caused by the opening operation and to prevent an increase in the device size.

The movable contact member of the movable contact part may be rotatably supported about an attachment position thereof in a circular direction. Hence, it is possible for the movable contact member to evenly make a contact with the stationary contact members without being locally biased. As a result, it is possible to effectively prevent the movable contact member 21 from being locally abraded and improve the reliability of contacting.

There may be provided an arc extinguish room which formed of a chamber having an opening, the stationary contact members being accommodated in the chamber. Hence, it is possible to rapidly extinguish an arc which occurs at the time of opening.

BRIEF DESCRIPTION OF THE DRAWINGS

The nature, utility, and further features of the present invention will be more clearly apparent from the following detailed description with respect to preferred embodiments of the invention when read in conjunction with the accompanying drawings briefly described below.

DESCRIPTION OF THE PREFERRED EMBODIMENTS (An Embodiment of the Present Invention)

Figure 1:
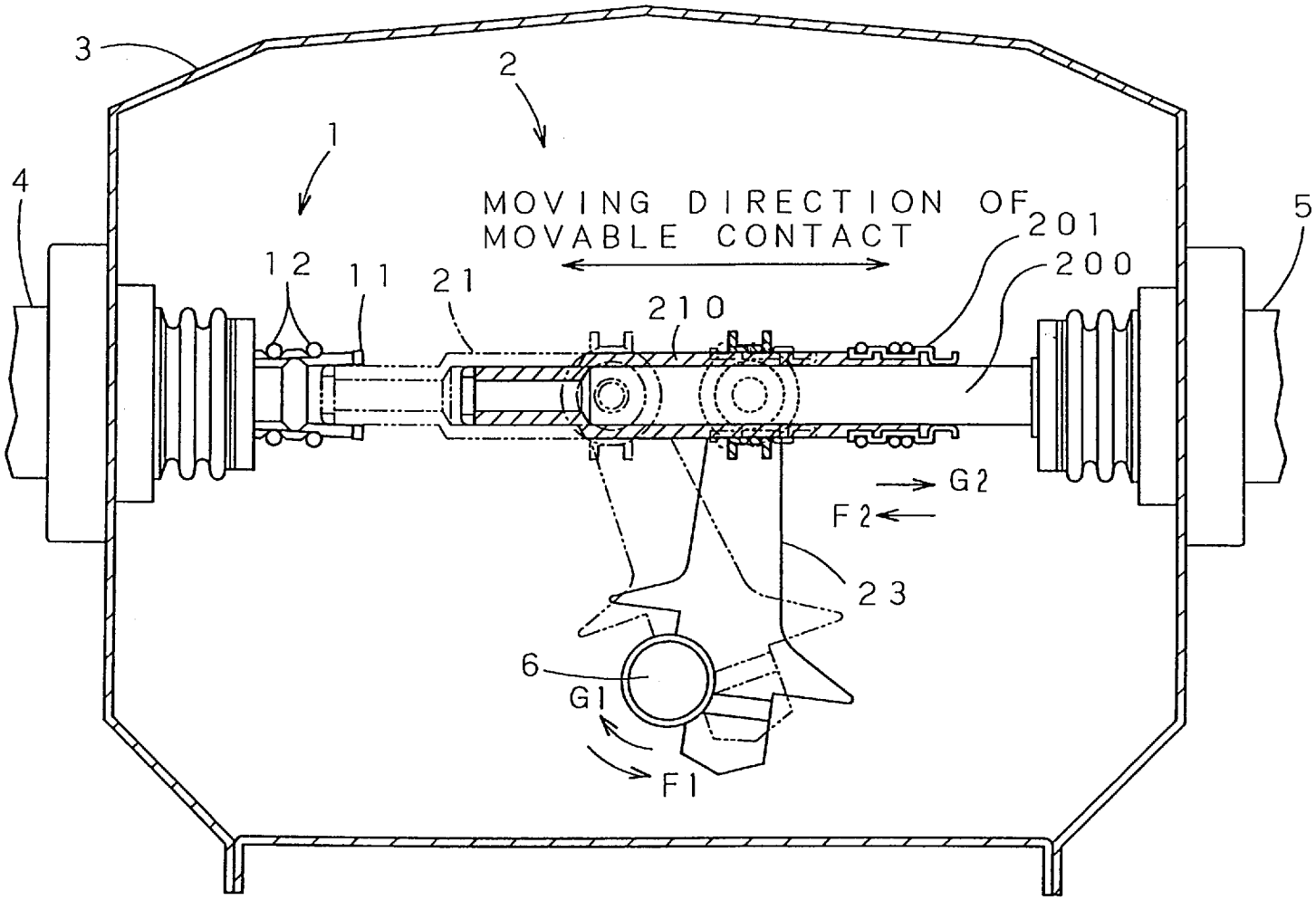
Fig. 1 PRIOR ART
FIG. 1 is a schematic cross-sectional view of a conventional gas circuit breaker.
Figure 2:
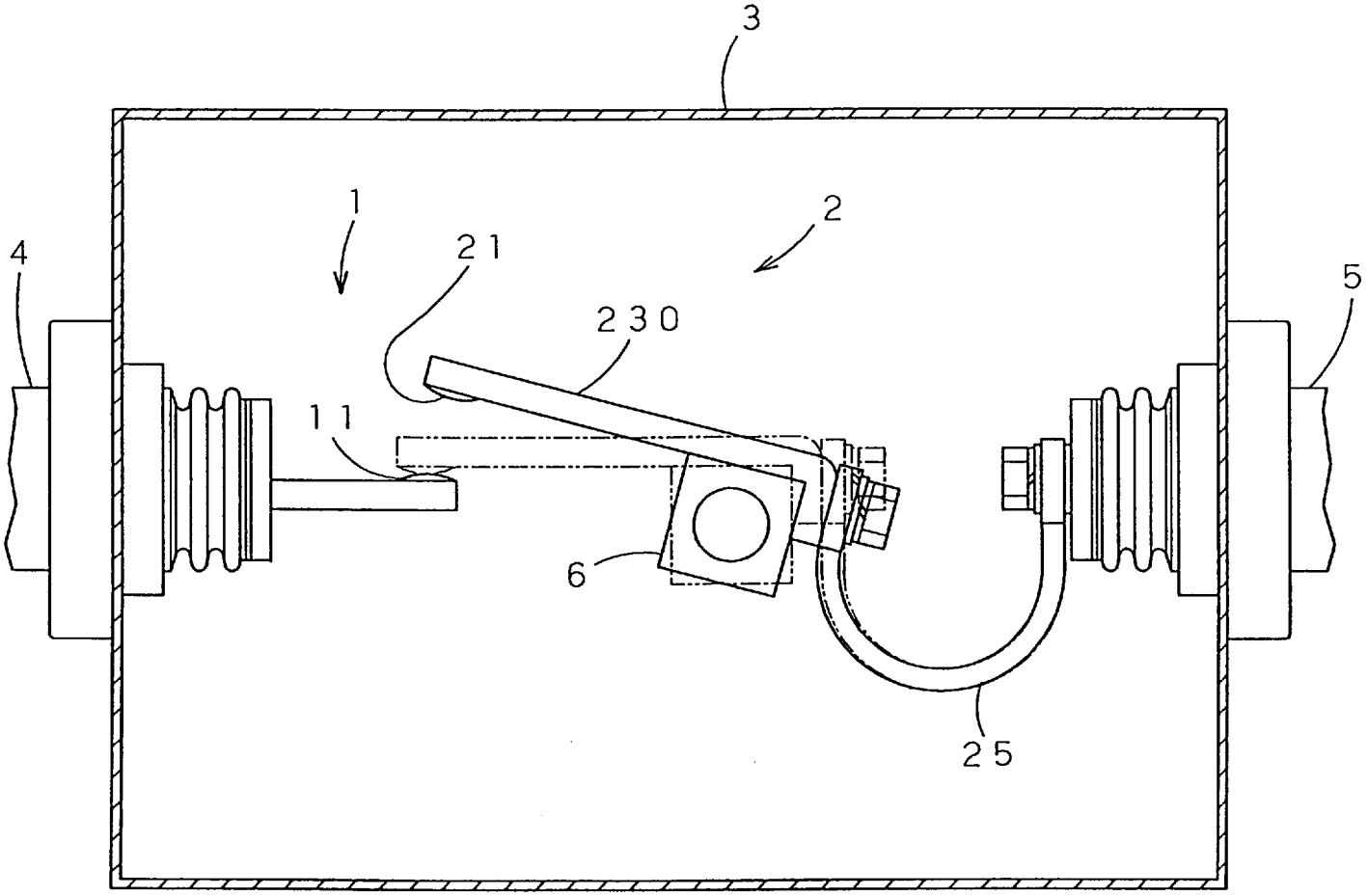
Fig. 2 PRIOR ART
FIG. 2 is a schematic cross-sectional view of another conventional gas circuit breaker.
Figure 3:
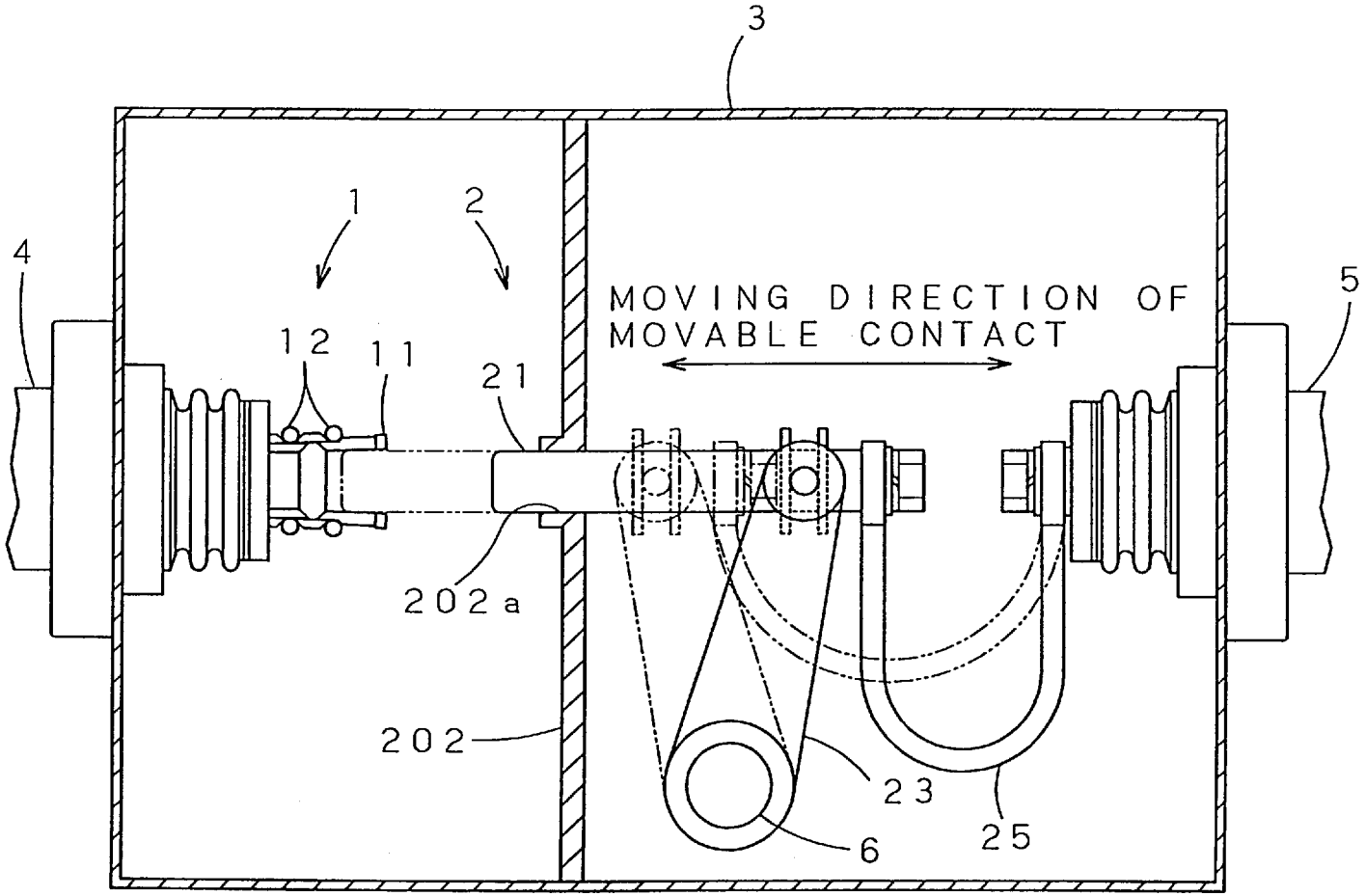
Fig. 3 PRIOR ART
FIG. 3 is a schematic cross-sectional view of yet another conventional gas circuit breaker.
Figure 4:
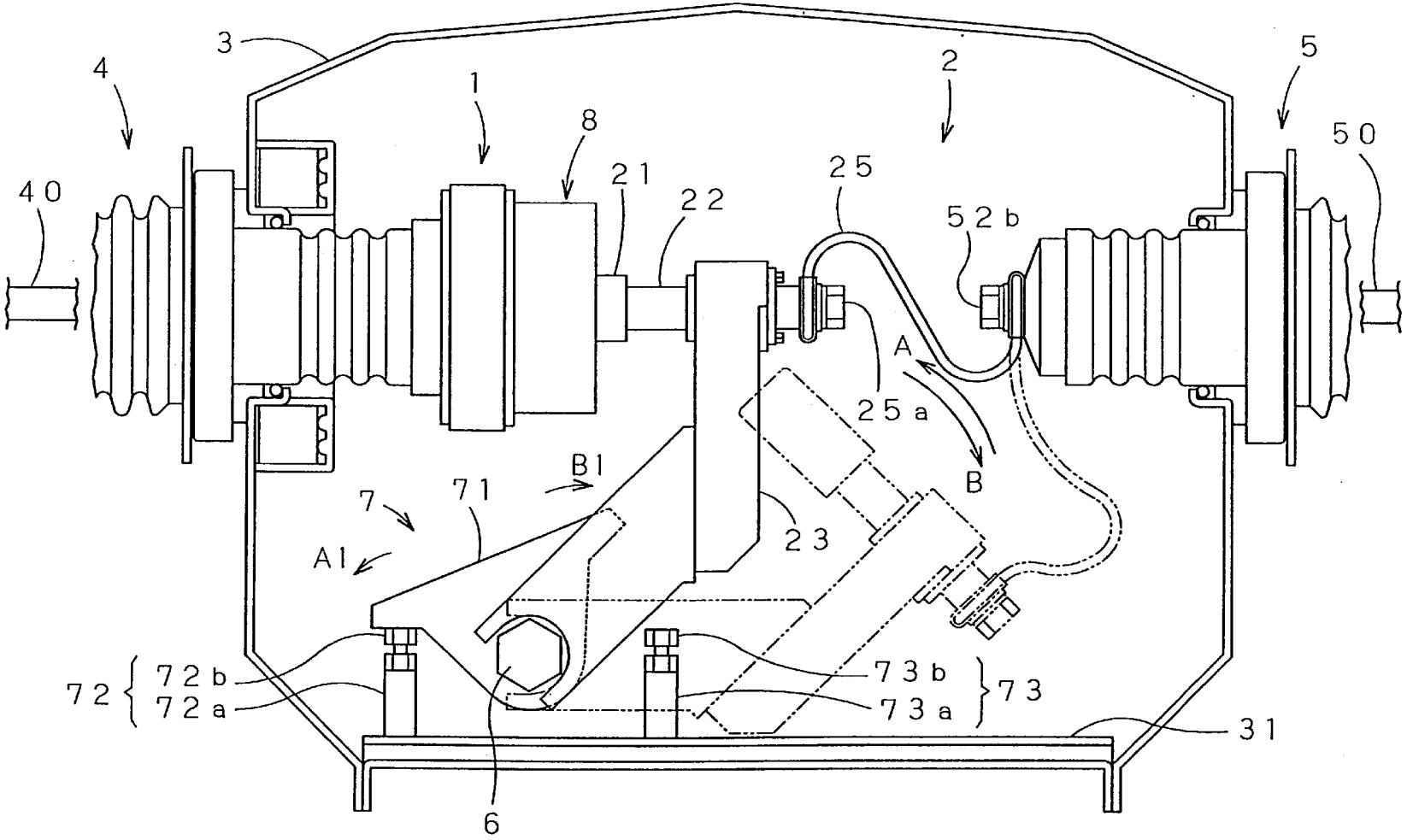
FIG. 4 is a-cross-sectional view of a gas circuit breaker according to an embodiment of the present invention.
Figure 5:
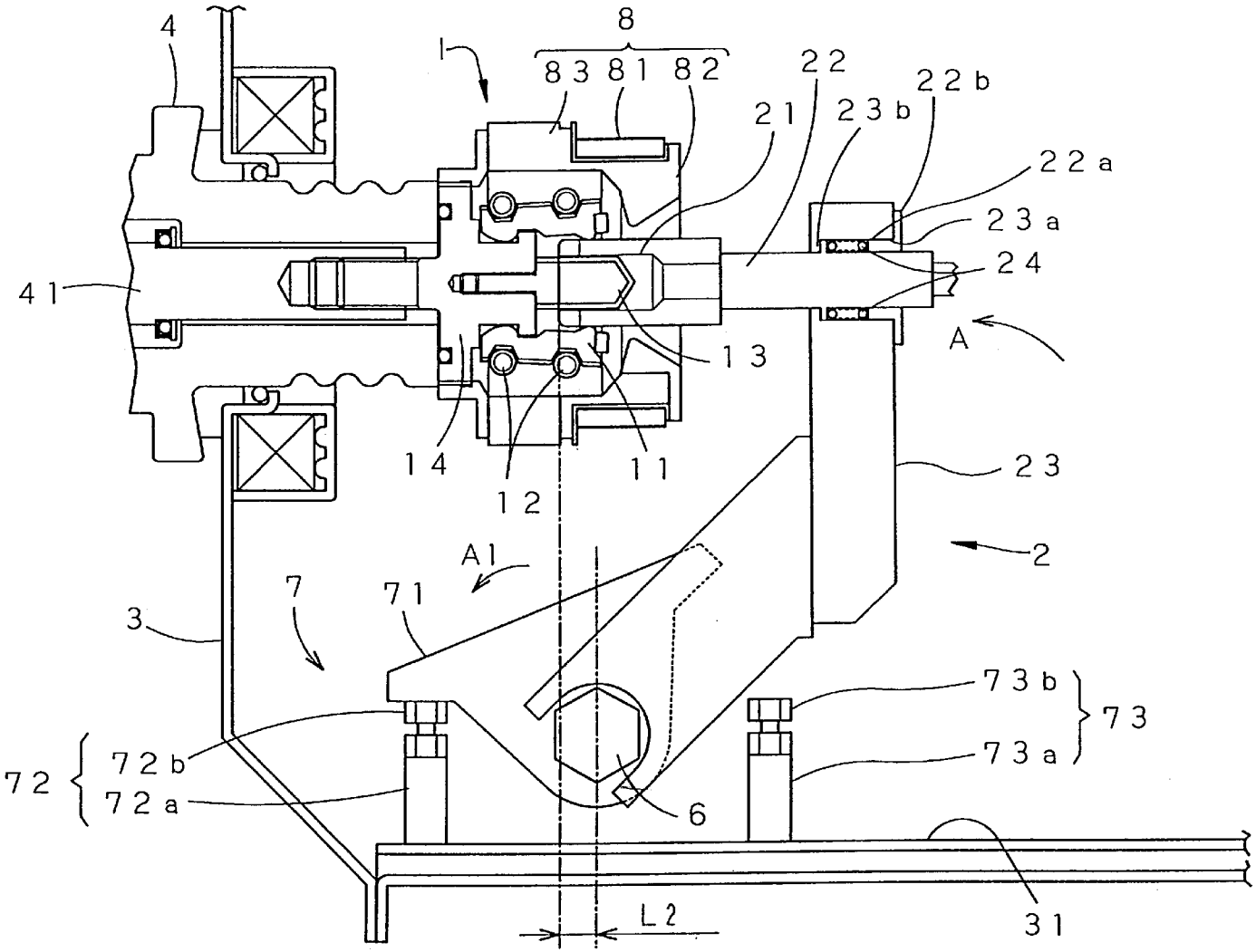
FIG. 5 is a diagram explaining an operation of the gas circuit breaker shown in FIG. 4 performed at the time of closing.
Figure 6:
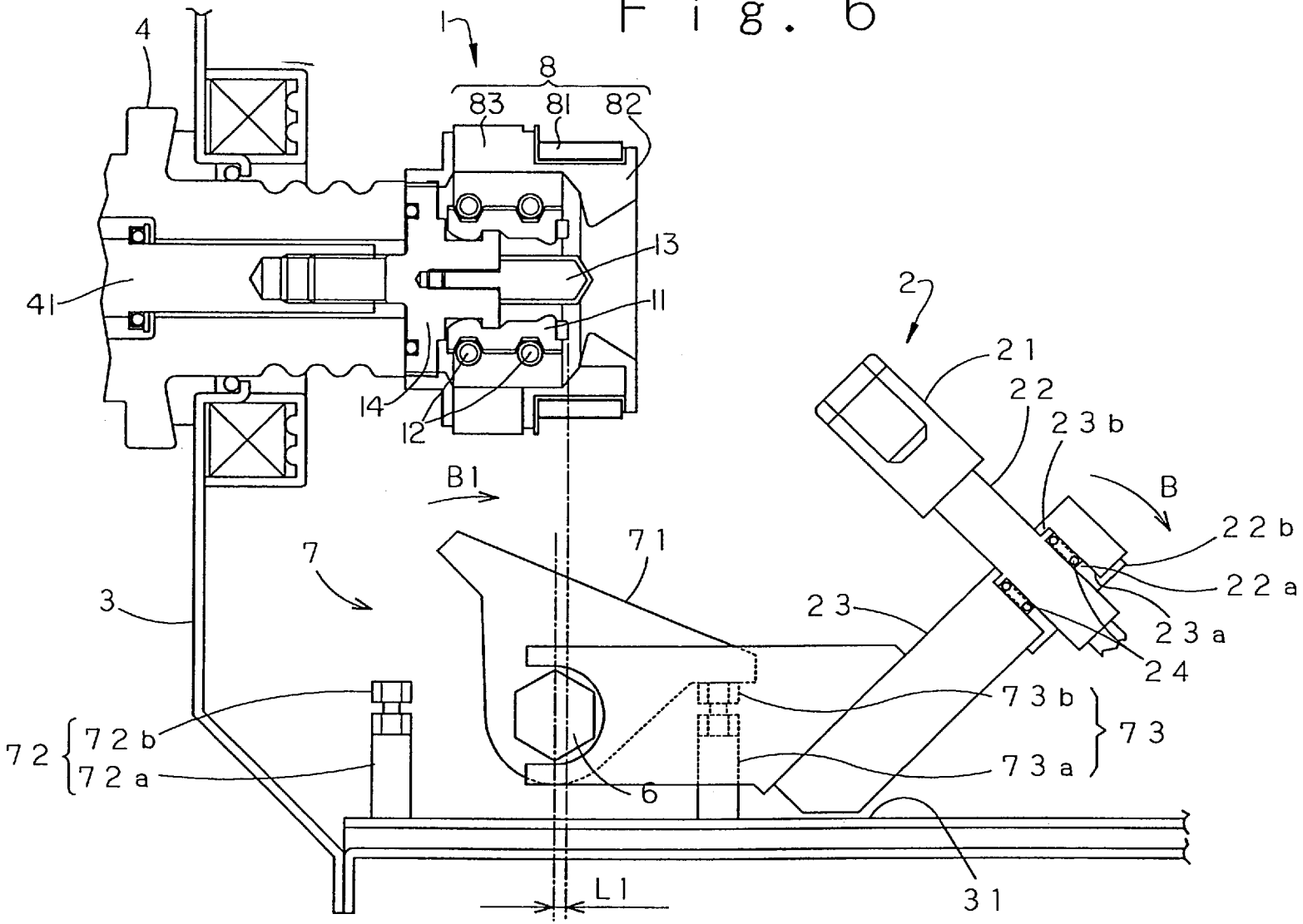
FIG. 6 is a diagram explaining an operation of the gas circuit breaker shown in FIG. 4 performed at the time of opening.

A description will now be given, with reference to FIGS. 4 through 6, of an embodiment of the present invention. FIG. 4 is a diagram of an internal structure of a gas circuit breaker according to the present embodiment, FIG. 5 is a diagram which explains a closing operation of the gas circuit breaker shown in FIG. 4, and FIG. 6 is a diagram which explains an opening operation of the gas circuit breaker shown in FIG. 4.

Referring to each of the above figures, the gas circuit breaker according to the present invention includes the case body 3, the power supply side busing 4, the load side busing 5, the stationary contact part 1, and the movable contact part 2. The base body 3 is a hermetically sealed chamber in which the $SF_6$ gas is enclosed. The power supply side busing 4 and the load side busing 5 respectively penetrate through the opposite walls of the case body 3 in the hermetically sealed state. The stationary contact part 1 is connected to a power supply line 40 and is attached to the end of the power supply side busing 4 located in the case body 3. Further, the stationary contact part 1 is accommodated in an arc extinguish room 8. The main shaft 6 is disposed on a side (lower side) of the stationary contact part 1. The movable contact part 2 is connected to a load line 50 of the load side bushing 5 through the flexible conductor 25. The movable contact part 2 includes the insulating arm 23, a supporting rod 22, a spring 24, and the movable contact member 21. The insulating arm 23 has a substantially C-shaped arm body having an end rotatably supported to the main shaft 6, and swings in response to the rotation of the main shaft 6. The supporting rod 22 is fitted into an attachment hole 23*a* formed in the other end of the arm body of the insulating arm 23. The spring 24 is accommodated in a fitting gap formed between the supporting rod 22 and the attachment hole 23*a*. The movable contact member 21 is attached to the end portion of the supporting rod 22 and is formed of an electrically conductive substance having a cylindrical shape having an opening in one of its ends to accommodate center guide part 13.

The above-mentioned spring 24 is located in the fitting gap formed between the supporting rod 22 and the attachment hole 23*a*, and is accommodated and held between an engagement projection part 23*b* formed in an end of the attachment hole 23*a* of the insulating arm 23 and an engagement projection part 22*a* of the supporting rod 22. Preferably spring 24 is designed to exert a force which is slightly less than a load which occurs when the movable contact member 21 is engaged with and inserted into the stationary contact members 11 of the stationary contact part 1 having the circular ring formation. Further, the elastic force of the spring 24 is greater than the inwardly urging, by the garter spring 12 upon the stationary contact members 11 arranged in the circular ring formation. The supporting rod 22 operates so that a pressure applying member 22*b* of the supporting rod 22 pushes and shields the engagement projection part 22*a* in the attachment hole 23*a* of the insulating arm 23 and the spring 24 from the outer side, and makes the part 22*a* and the spring accommodated and held with the engagement in the attachment hole 23*a*. The pressure applying member 22*b* prevents, before the following event happens, the supporting rod 22 from being disengaged from the attachment hole 23*a* of the insulating arm 23 due to inertia force or repulsion occurring at the time of closing or opening.

The above-mentioned stationary contact part 1 includes a stationary contact base 14, the stationary contact members 11 and a center guide part 13. The stationary contact base 14 is made of an electrically conductive substance and is screwed to a power supply side conductor 41 connected to the power supply line 40. The stationary contact members 11 are arranged in a circular-ring-shaped tulip formation so that the stationary contact members 11 project from the outer circumference end of the stationary contact base 14. The center guide part 13 projects from the front end of the stationary contact base 14 and is threaded into in the circular ring of the stationary contact members 11. The stationary contact members 11 are attached in a state in which the stationary contact members 11 are inwardly urged by an elastic force diverging towards the inside of the circular ring by means of the garter spring 12 attached to the outer circumference portion of the base 14.

A movable protruding piece 71 is rotatably fixed to the main shaft 6. A closing contact part 72 and an opening contact part 73 are provided on an auxiliary plate 31 of the case body 3 and are symmetrically arranged about the main shaft 6. A stopper 7 is made up of the movable protruding piece 71, the closing contact part 72 and the opening contact part 73. The stopper 7 is structured so that the movable protruding piece 71 is rotated in the direction indicated by arrow Al or B1 shown in the FIGS. 4 and 5 in accordance with the rotation of the main shaft 6 and is stopped when the movable protruding piece 71 strikes against the closing contact part 72 or the opening contact part 73. The closing contact part 72 has a base portion 72*a* and an adjustment screw 72*b*. The base portion 72*a* is fixed to the auxiliary plate 31. The adjustment screw 72*b* is threaded to the base portion 72*a*, and adjusts the stop position of the main shaft so that the height thereof is adjustable. The movable protruding piece 71 strikes against the head of the adjustment screw 72*b*. The opening contact part 73 is made up of a base portion 73*a* and an adjustment screw 73*b* in the same manner as the closing contact part 73, and defines an adjustable stopping position.

Next, a description will be given of the closing and opening operations of the embodiment of the present invention having the above-mentioned structure.

The closing operation of the gas circuit breaker commences with a process in which the main shaft 6 is rotated in the direction indicated by the arrow A1 shown in FIGS. 4 and 5 and the insulating arm 23 is thus rotated in the direction indicated by the arrow A. In response to the rotation of the insulating arm 23, the supporting rod 22 and the movable contact member 21 attached to the end of the supporting rod 22 are also rotated in the same direction as indicated by the arrow A. Accordingly, the movable contact member 21 are rotated into the stationary contact members 11 of the stationary contact part 1 arranged in the circular ring formation. In, this position movable contact member 21 contacts with the stationary contact members 11 and receives a reaction force therefrom. The spring 24 is contracted and absorbs the above reaction force. The repulsion (which corresponds to all elastic force) generated when the contracted spring 24 expands makes the movable contact member 21 snugly fitted into the stationary contact members 11 arranged in the circular ring formation and inwardly urged by the garter spring 12, whereby the closing operation is completed. In the above way, the spring 24 contracts and expands to thereby absorb shock power by the movable contact member 21, so that the repulsive function can be prevented beforehand and welding of the contact members can be prevented. The movable protruding piece 71 of the stopper 7 strikes against the closing contact part 72 at the same time as the movable contact member 21 is fitted into the stationary contact members 11. Hence, the spring 24 absorbs the reaction which occurs at that time and prevents the repulsive function, so that the closing operation is smoothed and welding of the contact members is prevented.

The opening operation of the gas circuit breaker starts to rotate the main shaft 6 by the elastic force of a not-shown spring for opening, whereby the insulating arm 23 is rotated in the direction indicated by the arrow B. In response to the rotation of the insulating arm 23, the movable contact member 21 attached to the end of the supporting rod 22 separates from the stationary contact members 11. In the movable contact part 2 after coming out of the stationary contact members 11, the insulating arm 23 is further rotated due to the inertia force of the rotation in the direction indicated by the arrow B. Then, the movable contact part 2 is stopped and the rotation of the main shaft 6 is stopped, when the movable protruding portion 71 of the stopper 7 strikes against the opening contact portion 72. The shock force of the reaction caused at the time of striking is absorbed by the spring 24, so that the repulsive function can be prevented and the opening operation can be smoothed.

(Other Embodiments of the Present Invention)

Figure 7A:
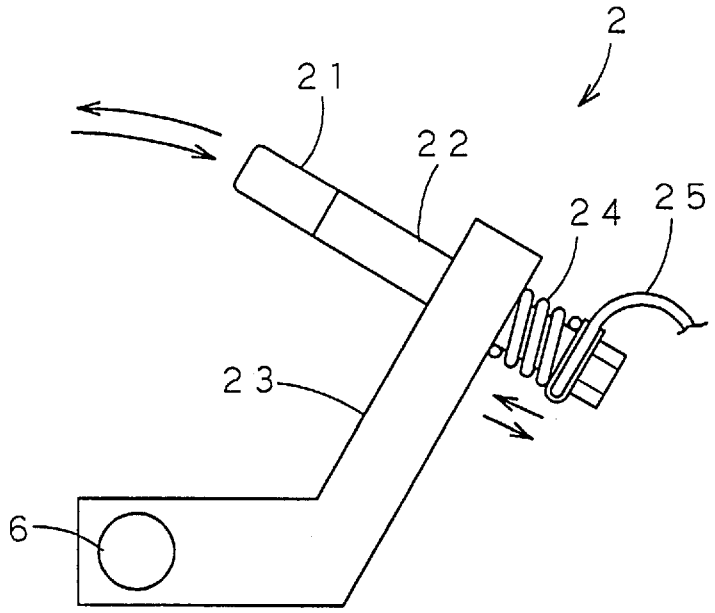
FIGS. 7A and 7B are cross-sectional views of a part of a gas circuit breaker according to another embodiment of the present invention.
Figure 7B:
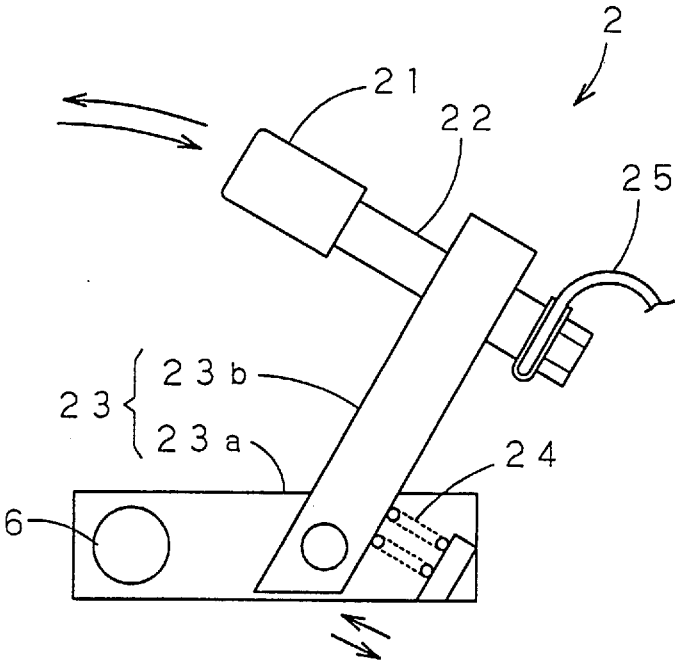

FIGS. 7A and 7B schematically show a structure of the movable contact part of a gas circuit breaker according to another embodiment of the present invention. Referring to FIG. 7A, the movable contact part 2 has, as in the case of the movable contact part 2 of the aforementioned of the present invention, the insulating arm 23, the supporting rod 22, the spring 24 and the movable contact member 21. However, the movable contact part shown in FIG. 7A differs from that of the aforementioned embodiment in the position of the spring 24. As shown in FIG. 7A, the movable contact member 21 is attached to the supporting rod 22 through the spring 24.

In FIG. 7B, the movable contact part 2 has the insulating arm 23 formed of two bendable members 23*a* and 23*b*, and the spring 24 is interposed between the two members 23*a* arid 23*b*. It is possible to employ an alternative of the structure shown in FIGS. 7A and 7B in which the spring 24 is provided in the movable contact part 2. In such an alternative, an elastic member such as a spring, rubber or resin is provided on the collision surface of the movable protruding piece 71 or the collision surfaces of the closing contact part 72 and opening contact part 73.

Figure 8A:
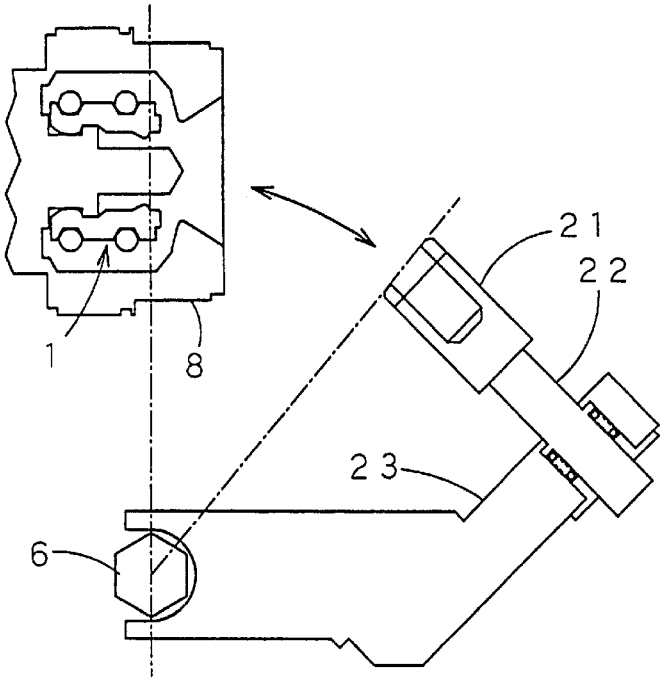
FIGS. 8A and 8B and are cross-sectional views of a part of a gas circuit breaker according to yet another embodiment of the present invention.
Figure 8B:
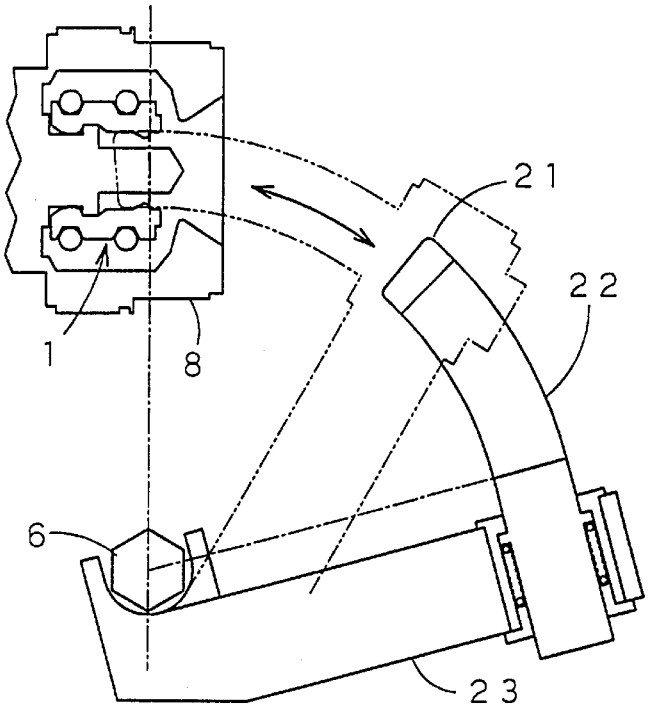

FIGS. 8A and 8B schematically show a structure of the movable contact part of a gas circuit breaker according to yet another embodiment of the present invention. Referring to FIG. 8A, the movable contact part 2 is configured so that an anti-arc contact piece attached to the end portion of the movable contact member 21 has an inner-circumference length in the circularly arching movement (indicated by the two-headed arrow) of the insulating arm 23 shorter than an outer-circumference length thereof. The different outer and inner lengths of the movable contact member 21 make it possible for the leading end of the anti-arc contact piece of the movable contact member 21 to evenly engage with the stationary contact members 11 of the stationary contact part 1 and to evenly disengage therefrom.

In the movable contact part 2 shown in FIG. 8B, the supporting rod 22 thereof is formed so as to have a circular arc shape along the circularly arching movement (indicated by the two-headed arrow) of the insulating arm 23. Hence, the movable contact member 21 can smoothly engage with the stationary contact members 11 and disengage therefrom.

In each of the above-mentioned embodiments of the present invention, the movable contact member 21 of the movable contact part 2 is attached to the supporting rod 22. Alternatively, the movable contact member 21 can be rotatably attached to the supporting rod 22. Hence, the movable contact member 21 can rotate about the supporting rod in the same direction as the circular direction of the supporting rod 22, so that the sliding surface of the movable contact member 21 can evenly slide on the stationary contact members 11 without being locally biased. Hence, it is possible to effectively prevent the movable contact member 21 from being locally abraded and improve the reliability of contacting. In the structure in which the movable contact member 21 is attached to the supporting rod 22 rotatably attached to the insulating arm 23 so as to rotate about the shaft, it is possible to effectively prevent the movable contact member 21 from being locally abraded and improve the reliability of contacting as in the case of the above embodiments of the present invention.

According to the present invention, the following advantages can be obtained. The tulip type stationary contact part having stationary contact members arranged in the tulip formation and the movable contact part having the movable contact member are accommodated in the base body in which the insulating gas is enclosed, and the movable contact part is rotatable about the shaft with respect to the stationary contact part, whereby a large-capacity electric line can be closed and opened at a high speed.

The movable contact part supports the insulating arm through an elastic member which expands and contracts in almost the same direction as a rotation of the movable contact part. Hence,it is possible to relax shock occurring when the movable contact member makes a contact with the stationary contact members, so that the recoil phenomenon occurring at the time of closing and opening can be eliminated and welding of the contact members can be prevented. This contributes to smoother closing and opening operations.

The elastic member of the movable contact part has an elastic force approximately equal to or slightly greater than the force generated when the movable contact member is engaged with and inserted into the stationary contact members. Hence, it is possible to suitably lessen the shock at the time of closing so that the closing and opening operation can be smoothed.

The elastic member of the movable contact part has an elastic force approximately equal to or slightly greater than the force generated when the movable contact member is engaged with and inserted into the stationary contact members, the elastic force being greater than an inward elastic force of the stationary contact members arranged in the circular ring formation. Hence, the closing load can be sufficiently absorbed because the elastic member is contacted due to the function of the elastic force (equal or less than the closing force) thereof. Then, the movable contact member can be smoothly inserted into the circular ring of the stationary contact members due to the inward elastic force less than the repulsive force (that is, elastic force) of the elastic member in the contracted state. As a result, it is possible to perform the closing and opening operations and prevent the recoil phenomenon.

There is provided a closing stopper stopping, in a predetermined position, a rotation of the movable contact member in a closing direction after the movable contact member moves to make a connection with the stationary contact members; and an opening stopper stopping, in another predetermined position, a rotation of the movable contact member in an opening direction after the movable contact member is released from the stationary contact members. Hence, at the time of closing, it is possible to soften the contact force between the movable contact member and the stationary contact members to hence prevent the parts from being damaged. At the time of opening, it is possible to prevent the movable contact members and the other parts from being damaged due to inertia force caused by the opening operation and to prevent an increase in the device size.

The movable contact member of the movable contact part is rotatably supported about an attachment position thereof in a circular direction. Hence, it is possible for the movable contact member to evenly make a contact with the stationary contact members without being locally biased. As a result, it is possible to effectively prevent the movable contact member 21 from being locally abraded and improve the reliability of contacting.

There is provided an arc extinguish room which is formed of a chamber having an opening, the stationary contact members being accommodated in the chamber. Hence, it is possible to rapidly extinguish an arc which occurs at the time of opening.

What is claimed is:

1. A gas circuit breaker comprising:

a case body in which an insulating gas is enclosed;

a stationary contact part accommodated in said case body and fixed to an inner wall of said case body, said stationary contact part including a plurality of stationary contact members a means for inwardly urging said plurality of stationary contact members, and a movable contact part accommodated in said case body and including a movable contact member provided on an end of an insulating arm, said insulating arm rotatably supported about a main shaft serving as a fulcrum, said insulating arm being rotated in response to a rotation of said main shaft so that the movable contact member makes and breaks electrical contact with said plurality of the stationary contact members.

2. The gas circuit breaker as claimed in claim 1, wherein the movable contact part supports the insulating arm through an elastic member which expands and contracts in generally the same direction as a rotation of the movable contact part.

3. The gas circuit breaker as claimed in claim 2, wherein said elastic member of the movable contact part has an elastic force approximately equal to or slightly greater than a load generated when the movable contact member is engaged with and inserted into the stationary contact members.

4. The gas circuit breaker as claimed in claim 2, wherein said elastic member of the movable contact part has an elastic force approximately equal to or slightly greater than a load generated when the movable contact member is engaged with and inserted into the stationary contact members, said elastic force being greater than an inward elastic force of the stationary contact members arranged in the circular ring formation.

5. The gas circuit breaker as claimed in any of claims 1 to 3, wherein:

a closing stopper stopping, in a predetermined position, a rotation of the movable contact member in a closing direction after the movable contact member moves to slake a connection with the stationary contact members; and an opening stopper stopping, in another predetermined position, a rotation of the movable contact member in an opening direction after the movable contact member is released from the stationary contact members.

6. The gas circuit breaker as claimed in any of claims 1 to 4, wherein said movable contact member of the movable contact part is rotatably supported about an attachment position thereof in a circular direction.

7. The gas circuit breaker as claimed in any of claims 1 to 4, further comprising an arc extinguish room which formed of a chamber having an opening, said stationary contact members being accommodated in said chamber; and the movable contact member passes through the opening of said chamber and is engaged with the stationary contact members.

* * * * *